US006335134B1

(12) United States Patent
Hagi et al.

(10) Patent No.: US 6,335,134 B1
(45) Date of Patent: Jan. 1, 2002

(54) TONER FOR AN ELECTROSTATIC LATENT IMAGE DEVELOPMENT

(75) Inventors: Masayuki Hagi, Minoo; Yoshihiro Mikuriya, Nishinomiya; Takeshi Arai, Akashi; Kenichi Kido; Yoshitaka Sekiguchi, both of Nishinomiya; Tetsuo Sano, Amagasaki; Megumi Aoki, Itami; Junichi Tamaoki, Sakai, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/630,433

(22) Filed: Aug. 1, 2000

(30) Foreign Application Priority Data

Aug. 3, 1999 (JP) ..... 11-219834

(51) Int. Cl.[7] ..... G03G 9/097
(52) U.S. Cl. ..... 430/108.1; 430/125
(58) Field of Search ..... 430/106, 106.6, 430/109, 111, 108.1, 125

(56) References Cited

U.S. PATENT DOCUMENTS 4,513,074 A * 4/1985 Nash et al. ..... 430/106.6
4,883,736 A 11/1989 Hoffend et al. ..... 430/110
5,275,905 A 1/1994 Ciccarelli et al. ..... 430/110
5,627,003 A * 5/1997 Laing et al. ..... 430/125
6,177,223 B1 * 1/2001 Hashimoto et al. ..... 430/109

FOREIGN PATENT DOCUMENTS

JP 05-72798 3/1993
JP 06-282096 10/1994

* cited by examiner

*Primary Examiner*—John Goodrow

(57) ABSTRACT

The toner composition comprises an aliphatic higher alcohol (1) or a higher fatty acid (2):

$$H\text{-}(CH_2)_n\text{-}OH \text{ (n: an integer)} \quad (1)$$

$$H\text{-}(CH_2)_m\text{-}COOH \text{ (m: an integer)} \quad (2)$$

wherein number-average carbon atom numbers of the aliphatic higher alcohol or higher fatty acid ore 21–29, contents of the ingredients having carbon atom numbers of not more than 20 are not more than 2% by weight, and contents of the ingredients having carbon atom numbers of not less than 30 are not more than 2% by weight.

20 Claims, No Drawings

TONER FOR AN ELECTROSTATIC LATENT IMAGE DEVELOPMENT

This application is based on an application No. 219834/1999 filed in Japan, the contents of which are hereby incorporated by reference.

BACKGROUND OF THE INVENTION

1. Field of the Invention

The present invention relates to a toner for an electrostatic latent image development which may be used in an electrophotography, an electrostatic printing and the like.

2. Description of the Related Art

In the fields of the electrophotography and electrostatic printing, there are problems that inorganic fine particles which are added to toner particles are adhered to a photosensitive member, and black spot (BS) which brings about image defects is occurred in a process of a blade cleaning.

For example, the following prior arts have heretofore been proposed in order to solve these problems.

U.S. Pat. No. 4,883,736 teaches that toner spots can be suppressed by adding internally or externally a higher alcohol whose carbon atom numbers are 30–300, preferably 30–50. Japanese Patent Publication (KOKAI) No. 282096/1994 discloses that it is possible to suppress a comet or a filming of fine powders onto the photosensitive member in the blade cleaning by employing a higher alcohol in the case where an external additive is used within a specified range.

In Japanese Patent Publication No. 72798/1993, a technical idea is exemplified wherein a carboxylic acid having a lower alkyl chain is added to toner particles as a solid lubricant in order to solve the aforementioned problems. However, in fact the technical idea has a problem that a heat resistance of the toner to which the carboxylic acid is externally added becomes worse, and the toner is not fit for a practical use unless the carboxylic acid is converted to a metallic salt in order to increase a melting point of the acid.

According to the aforementioned prior arts, the functions to suppress noises on the photosensitive member may be explained by a technical idea wherein the higher alcohol or higher fatty acid forms a lubricative film on the photosensitive member at the time of cleaning, and the lubricative film suppress the adhesion and filming of the toner components onto the photosensitive member. With respect to the electrophotographic process having the blade cleaning process, it has publicly been known that the adhesion and filming (black spot (BS)) of the inorganic fine powders and other components of the toner can be suppressed by externally adding the higher alcohol or higher fatty acid.

However, as described in any of the aforementioned publications, it has been indicated that there is a problem that a maintenance of heat resistance of the toner cannot be ensured unless carbon atom numbers of the higher alcohol or higher fatty acid employed in these prior arts are 30 and more from the viewpoint of the relationship between the carbon atom numbers and a starting point of a melting of said higher alcohol or higher fatty acid. According to a follow-up test by the inventors of the present application to confirm the effect of the higher alcohol described in the aforesaid publications, it has been confirmed that (i) a large quantity of the higher alcohol is necessary to suppress BS, (ii) an effect of forming the lubricative film is insufficient, and (iii) problems, such as a poor electrification of the toner, a decrease of an environmental stability and the like are newly occurred when a large amount of the higher alcohol is added to the toner particles.

In consideration of the functions of the aforementioned higher alcohol or higher fatty acid, although there is a reason to expect that the higher alcohol or higher fatty acid having lower molecular weight may bring about a higher effect from the viewpoint of the suppression of the adhesion and filming onto the photosensitive member, they cause a lethal problem that the heat resistance of the toner becomes worse. The prior arts could not cope with the problem.

SUMMARY OF THE INVENTION

The present invention provides a toner composition which suppresses an occurrence of BS (black spot) which brings about image defects in the process of a blade cleaning, said black spots being caused by an adhesion of inorganic fine particles which are added to the toner particles to the photosensitive member.

The present invention relates to a toner for an electrostatic latent image development which comprises the following aliphatic higher alcohols (1) or higher fatty acid (2) as an external additive:

$$H\text{-}(CH_2)_n\text{-}OH \text{ (n: an integer)} \quad (1)$$

$$H\text{-}(CH_2)_m\text{-}COOH \text{ (m: an integer)} \quad (2)$$

wherein number-average carbon atom numbers of the aliphatic higher alcohol or the higher fatty acid are 21–29, contents of the ingredients having carbon atom numbers of not more than 20 are not more than 2% by weight, and contents of the ingredients having carbon atom numbers of not less than 30 are not more than 2% by weight.

DETAILED DESCRIPTION OF THE PREFERRED EMBODIMENTS

In the investigating course to achieve the present invention, it has been proven that the higher alcohols or the higher fatty acids which have formerly been on the market as a general-purpose product contain large amounts of hydrocarbons having no hydroxyl group or carboxyl group, and that the commercially available products having carbon atom numbers of not less than 30 actually contain not less than 3% by weight of the ingredients whose carbon atom numbers are not more than 20.

The high-purity higher alcohols (e.g., Uniline Alcohol™ (Petroright Co.) and the like) or higher fatty acids (e.g., Unisit™ (Petroright Co.) and the like) which are produced by a different process from a general preparation process have been on the market, and said high-purity products are actually employed in the examples of the aforementioned prior arts. However, as regards these higher alcohols and higher fatty acids, it becomes clear that although contents of the hydrocarbons become little, a molecular weight distribution is broad and few percents of the ingredients whose carbon atom numbers are not more than 20. According to the results of actual differential thermal analyses of these commercially available higher alcohols and higher fatty acids by means of a differential scanning calorimeter (DSC), it has been confirmed that the higher alcohols or fatty acids whose carbon atom numbers are not less than 30 begin to slightly exhibit an endothermic process from around 50° C. Therefore it could have easily been predicted that these higher alcohols or fatty acids exert bad influence on the heat resistance of the toner in the case where large amounts of these compounds are added to the toner.

The present inventors have purified the general-purpose aliphatic higher alcohols or higher fatty acids which are on the market in such a way that a purity of single molecular weight of these compounds whose carbon atom numbers are 15–40 becomes not less than 98%, and prepared plural standard samples according to a molecular difference of said purified compounds. A starting temperature of a melting of the single standard sample or homogeneous mixtures thereof was measured by means of DSC. According to the results of these measurements, it could have been confirmed that the starting temperature of the melting (starting temperature of the endothermic process) becomes not less than 55° C. provided that a distribution of molecules whose carbon atom numbers are not more than 20 is not more than 2% by weight even if average carbon atom numbers of the higher alcohols or higher fatty acids are not more than 29. From a viewpoint of a maintenance of the heat resistance, the desirable starting temperature of the melting is not less than 55° C. If said temperature becomes less than 50° C., said maintenance becomes worse, and the higher alcohols or the higher fatty acids could not be used. On the other hand, it has been proven that it is necessary to add large amounts of the high-purity higher alcohols or higher fatty acids having carbon atoms of not less than 30 in order to suppress BS, said higher alcohols or higher fatty acids being regarded as a suitable additive in the prior arts, and that said higher alcohols or higher fatty acids do not necessarily have a suitable molecular weight for the suppression of BS.

Meanwhile it has been found out that the suppression effect of BS becomes insufficient if the higher alcohols or higher fatty acids whose melting points are too high are present.

Judging from the above investigated results, the present inventors conjectured that low-molecular ingredients having carbon atoms of not more than 29 actually contribute to the suppression of BS in the case of the higher alcohols or higher fatty acids having average carbon atom numbers of not less than 30 which are regarded as an effective additive in the prior arts, and that the carbon atom numbers are specified based on a balance between the heat resistance and the suppression of BS because the investigations of the prior arts did not cover these molecular weight distribution.

In the present invention, the aforementioned problems could be solved by specifying the ranges or the molecular weight distributions and purities of the aliphatic higher alcohols or the higher fatty acids, said molecular weight distributions and purities being not investigated in the prior arts.

According to the present invention, it is possible to suppress BS and to achieve a sufficient heat resistance by adding dramatically small amounts of the higher alcohols or higher fatty acids to the toner. In addition, it is possible to minimize an influence on the other properties of the toner because a sufficient suppression of BS can be achieved by adding not more than 1 part by weight of the higher alcohols or higher fatty acids to 100 parts by weight of toner particles.

The functions of the present invention will be explained hereinafter.

It is possible to insure the starting temperature of the melting of at least 55° C. because the aliphatic higher alcohols or higher fatty acids used in the present invention hardly contain the low-molecular ingredients whose carbon atom numbers are not more than 20, and there is little influence thereof on the maintenance of -heat resistance of the toner.

Furthermore, it is thinkable that a formability of a lubricating film at the time of blade cleaning becomes favorable without being too hard, and a surface energy of the photosensitive member is lowered to make an adhesion of the components of the toner difficult because the aliphatic higher alcohols or higher fatty acids used in the present invention hardly contain the high-molecular ingredients whose carbon atom numbers are not less than 30.

Namely, as the heat resistance and the formability of lubricating film on the photosensitive member of the toner are contrary properties, the best range of carbon atom numbers of the aliphatic higher alcohols or higher fatty acids is an range of 21–29 for a compatibility of the both properties. In addition, the object of the present invention can also be achieved provided that a distribution of the ingredients whose carbon atom numbers are not more than 20 is not more than 2% and that a distribution of the ingredients whose carbon atom numbers are not less than 30 is not more than 2%.

The toner according to the present invention contains (i) toner particles comprising at least a binding resin and a colorant and (ii) the aliphatic higher alcohols and/or higher fatty acids which are externally added to the toner particles, and a releasant and a charge-controlling agent are suitably added to the toner particles as occasion demands. Furthermore, post-treating agents, such as a fluidizing agent and the like are externally added to the toner particles as occasion requires.

The publicly known binder resins may be employed as the binder resin in the present invention. For example, the following resins are suitably employed: styrene resins, acrylic resins (e.g., alkyl acrylate resin, alkyl methacrylate resin and the like), styrene-acrylate copolymerization resins, polyester resins, silicone resins, olefin resins, amido resins, epoxy resins and the like.

In order to increase a light permeability of OHP and a color reproducibility of the superposed image, high transparency, low melting viscosity and high sharp melt property are required for the binding resin for a full color toner. Polyester resins are suitable for the binding resin having these properties.

As the full color toner contains the binder resin having the aforesaid properties, it is necessary to externally add many post-treating agents to the toner particles in order to increase a fluidity and a blocking tendency.

With respect to the binder resin used for full color toners such as cyan toner, magenta toner and yellow toner in the present invention, those resins having the following properties are preferably used: a number-average molecular weight (Mn) of 3000 to 6000, preferably 3500 to 5500, a ratio Mw/Mn of weight-average molecular weight (Mw) to number-average molecular weight (Mn) of 2 to 6, preferably 2.5 to 5.5, a glass transition point of 50 to 70° C., preferably 55 to 70° C., and a softening point of 90 to 110° C., preferably 90 to 105° C.

The number-average molecular weight less than 3000 of the binder resin tends to cause image defects (degradation in fixing properties at the time the sheet is bent) due to separation of image portions when a full-color solid image is bent. The number-average molecular weight exceeding 6000 causes deterioration in the thermal fusing properties with the result that the fixing strength is lowered. The value of Mw/Mn smaller than 2 tends to cause high-temperature offset. The value exceeding 6 tends to cause deterioration in the sharp melting properties at the time of fixing, resulting in deterioration in the toner light-transmitting properties and the color-mixing properties at the time of a full-color image-formation. The glass transition point lower than 50° C. makes the heat resistant properties of the toner insufficient, making the toner susceptible to aggregation at the time of storing. The glass transition point higher than 75° C. causes deterioration in the fixing properties as well as deterioration in the color-mixing properties at the time of a full-color image formation. The softening point lower than 90° C. tends to cause high-temperature offset, and the value exceeding 110° C. tends to cause deterioration in the fixing strength, the light-transmitting properties, the color-mixing properties and the gloss properties in full-color images.

The publicly known pigments and dyes may be adopted as a colorant. Examples thereof include carbon black, aniline blue, Chalco Oil Blue, chrome yellow, ultramarine blue, DuPont Oil Red, quinoline yellow, methylene blue chloride, copper phthalocyanine, Malachite green oxalate, Lump Black, Rose Bengal. As a colorant for the magenta toner, C.I. Pigment Red 48:1, C.I. Pigment Red 122, C.I. Pigment Red 57:1 and C.I. Pigment Red 184 may be employed. As a colorant for yellow toner, C.I. Pigment Yellow 97, C.I. Pigment Yellow 12, C.I. Pigment Yellow 180, C.I. Pigment Yellow 17, C.I. Pigment Yellow 93 and C.I. Solvent Yellow 162 may be employed. As the colorant for the cyan toner, C.I. Pigment Blue 15:1 and C. I. Pigment Blue 15:3 may be employed. When the toner of the present invention is used as a magnetic toner, some or all amount of the colorant may be replaced by a magnetic material. Examples of such a magnetic material include magnetite, ferrite, iron power, nickel powder, etc.

From the viewpoints of an afforability of fluidity, an increase of cleanability and the like of the toner according to the present invention, post-treating agents may be added to and mixed with the toner particles. Although the post-treating agents are not particularly restricted, the following additives may be employed: inorganic oxide fine particles (e.g., silica fine particles, alumina fine particles, titanium fine particles and the like), fine particles of metallic salts of stearic acid (e.g., aluminum stearate fine particles, zinc stearate fine particles and the like) and inorganic titanate fine particles (e.g., strontium titanate fine particles, zinc titanate fine particle and the like). These additives can be used independently or jointly. From the viewpoints of the environmental stability and the maintenance of heat resistance, it is desirable to use these fine particles after their surfaces are treated with a silane coupling agent, a titanium coupling agent, a higher fatty acid, a silicone oil and the like. An adding amount of these fine particles is 0.05–5 parts by weight, preferably 0.1–3 parts by weight relative to 100 parts by weight of the toner particles.

In order to increase the anti-offset properties, etc., the toner of the present invention may contain a wax as a releasant. Examples of such a wax include polyethylene wax, polypropylene wax, carnauba wax, rice wax, sazol wax, montan ester waxes, Fischer-Tropsch wax, etc. In the case of addition of a wax to the toner, the content is preferably in the range of 0.5 to 5 parts by weight relative to 100 parts by weight of the binder resin. Thereby, it becomes possible to obtain the effects of the addition without causing disadvantages, such as filming, etc.

From the viewpoint of improvement in anti-offset properties, polypropylene wax is preferably contained. From the viewpoint of improvements in smear-preventive properties ("smear" means a phenomenon in which, when a paper-sheet with images copied on its one side is fed by an automatic document-feeding apparatus or in a double-sided copying machine, degradation in the copied image, such as blurring and stains, occurs due to friction between the sheets or between the sheet and rollers on the image), polyethylene wax is preferably contained. From the above-mentioned viewpoints, the polypropylene wax is preferably set to have a melt viscosity of 50 to 300 cps at 160° C., a softening point of 130 to 160° C. and an acid value of 1 to 20 KOH mg/g. The polyethylene wax is more preferably set to have a melt viscosity of 1,000 to 8,000 cps at 160° C. and a softening point of 130 to 150° C. The polypropylene wax having the above-mentioned melt viscosity, softening point and acid value exhibits a superior dispersing properties to the binder resin. The anti-offset properties are improved without causing problems due to isolated wax. In addition, the polyethylene wax having the above-mentioned melt viscosity, softening point and acid value also exhibits a superior dispersing properties to the binder resin. The polyethylene wax can increase the smear-preventive properties by decreasing a friction coefficient of the fixed image surface without causing problem due to isolated wax. Further, the melt viscosities of the waxes were measured by means of Brookfield type viscometer.

As a charge-control agent for a positive charge-toner, the following positive charge-control agents are exemplified: Nigrosine Base EX of azine compounds, Bontron N-01, Bontron N-02, Bontron N-04, Bontron N-05, Bontron N-07, Bontron N-09, Bontron N-10, Bontron N-13 (Orient Kagaku Kogyo Co.); Oil Black (Chuou Gosei Kagaku Co.); quaternary ammonium salt P-51, polyamine compound P-52, Sudan Chief Schwartz BB (Solvent Black 3: C.I. No. 26150), Fett Schwartz HBN (C.I. No. 26150), Brilliant Spirit Schwartz TN (Farbenfabriken Bayer Co.); alkoxylated amine, alkyl amide, molybdenum acid chelate pigments, imidazole compounds and the like.

As a charge-control agent for a negative charge-toner, the following negative charge-control agents are exemplified: chrome complex type azo dyes S-32, S-33, S-34, S-35, S-37, S-38, S-40 (Orient Kagaku Kogyo Co.); Aizen Spilon Black TRH, Aizen Spilon Black BHH (Hodogaya Kagaku Co.); Kayaset Black T-22, Kayaset Black 004 (Nihon Kagaku Co.); Copper phthalocyanine dye S-39 (Orient Kagaku Kogyo Co.); chrome complexes E-81, E-82 (Orient Kagaku Kogyo Co.); zinc complex E-84 (Orient Kagaku Kogyo Co.); aluminum complex E-86 (Orient Kagaku Kogyo Co.); calix arene compounds and the like.

With respect to the negative charge-control agent used for full color toners, colorless, white or light-colored charge-control agents, which do not give adverse effects on the tone and the light-transmitting properties of the color toner, may be applied. Examples thereof include metal complexes of zinc and chromium of salicylic acid derivatives, calix arene compounds, organic boron compounds, quaternary ammonium salt compounds containing fluoride, etc. With respect to the metal complex of salicylic acid derivative, for example, those disclosed in U.S. Pat. No. 4,206,064, U.S. Pat. No. 4,762,763 etc. may be adopted. With respect to calix arene compounds, for example, those disclosed in U.S. Pat. No. 5,049,467, etc. may be adopted. With respect to organic boron compounds, for example, those disclosed in U.S. Pat. No. 5,863,692, etc. may be adopted. With respect to quaternary ammonium salt compounds containing fluoride, for example, those disclosed in U.S. Pat. No. 5,069,994, etc. may be adopted.

With respect to the aliphatic higher alcohols or higher fatty acids which are externally added to the surfaces of the toner particles, the number-average carbon atom numbers of said alcohols or fatty acids are 21–29, and the weight percentage of the ingredients whose carbon atom numbers are not more than 20 and the weight percentage of ingredients whose carbon atom numbers are not less than 30 are both not more than 2%. The aforesaid higher alcohols or higher fatty acids may be a single ingredient or a mixture thereof.

In the case where the number-average carbon atom numbers are not more than 20 or where the weight percentage of the ingredients whose carbon atom numbers are not more than 20 is not less than 2% even if the number-average carbon atom numbers are not less than 21, the starting temperature of melting becomes lower than 52° C., and the heat resistance of the toner when said alcohols or fatty acids are added to the surfaces of the toner particles becomes worse. Therefore these embodiments are not preferable.

On the other hand, in the case where the number-average carbon atom numbers are not less than 30 or where the weight percentage of the ingredients whose carbon atom numbers are not less than 30 is not less than 2% even if the number-average carbon atom numbers are not more than 29, their lubricative film-forming properties on the photosensitive member becomes worse and their BS suppressing effects are decreased because their melting points become higher to increase their hardness. Therefore these embodiments are also unpreferable.

Preferable average particle sizes of the aliphatic higher alcohols or higher fatty acids employed in the present invention are 2–10 μm, more preferably 4–8 μm. It is suitable to employ the higher alcohols or higher fatty acids from which the ingredients having finer particle sizes are removed. When said average particle sizes are less than 2 μm, the charging property and heat resistance of the toner become worse and the problems such as the filming to the photosensitive member and the like may occur. Therefore this embodiment is not preferable. On the other hand, when the average particle sizes are more than 10 μm, the lubricative film-forming effect on the photosensitive member becomes weak and the problem may occur wherein a blank will appear around the coarse particles at the time of transferring the toner. Therefore this embodiment is also unpreferable.

Although an adjusting method of the particle sizes is not particularly restricted, a dry process wherein a solid block of the aforesaid alcohols or fatty acids is ground in a dry state and the ground powders are classified or a wet process wherein said alcohols or fatty acids are emulsified in a liquid and the emulsion is subjected to a drying treatment can be employed.

With respect to an adding amount of aliphatic alcohols or fatty acids, it is preferable to use 0.05–3 parts by weight, more preferably 0.1–1 part by weight relative to 100 parts by weight of the toner particles. When the adding amount is less than 0.05 part by weight, BS suppressing effect is remarkably decreased. On the other hand, when the adding amount is more than 3 parts by weight, an electrification amount of the toner is decreased and a fogging of an image will occur. Therefore both embodiments are unpreferable.

With respect to a process for preparing the toner of the present invention, any of the publicly known preparation methods can be employed. For example, dry processes, such as grinding method and the like, and wet processes, such as an emulsion polymerization method, a suspension polymerization, an emulsion granulation method and the like can be mentioned. Generally speaking, the grinding method provides the particles having an indefinite shape, and the wet processes provide spherical particles. The preparation methods of the toner which is suitable for an image formation process may be employed. From the viewpoint of an image quality, a toner having a small particle size is preferably employed, and the loners having volume-average particle sizes of about 4–10 μm can suitably be used. In particular, the object of the present invention relating to the toner can be achieved by adopting any of the preparation methods and particle sizes.

With respect to a process for externally adding the aliphatic higher alcohols or higher fatty acids used in the present invention to the toner particles as an external additive, a general process is as follows: said alcohols or fatty acids are mixed with the toner matrix particles together with the post-treating agents (e.g., a fluidity-affording agent, an improver of cleanability and the like), and then the mixture is treated by means of Henschel mixer. However the process for adding said external additive is not restricted to the general process.

As regards a composition of the developer, although magnetic one-component developer, non-magnetic one-component developer, magnetic two-component developer and non-magnetic two-component developer may generally be used, the object of the present invention relating to the toner can be achieved by employing any of these developers.

EXAMPLE

The present invention is concretely explained by the following examples hereinafter.

Preparation of the Aliphatic Higher Alcohols

The commercially available linear chain aliphatic higher alcohols were purified by a fractionating method to prepare the higher alcohols having different average carbon atom numbers and carbon atom number distributions. The prepared higher alcohols were mixed and kneaded with a kneader, and then pulverized by means of an air-jet type pulverizer. The pulverized higher alcohols were classified by means of a zigzag type classifier to obtain the particles of the following higher alcohols A–G whose average particle size is 6 μm.

Higher alcohol A
- average carbon atom number: 22
- contents of the ingredients (C≦20): 1.9% by weight
- contents of the ingredients (C≧30): 0.4% by weight
- starting temperature of melting (endothermic process): 57° C.

Higher alcohol B
- average carbon atom number: 25
- contents of the ingredients (C≦20): 0.5% by weight
- contents of the ingredients (C≧30): 0.4% by weight
- starting temperature of melting (endothermic process): 60° C.

Higher alcohol C
- average carbon atom number: 28
- contents of the ingredients (C≦20): 0.5% by weight
- contents of the ingredients (C≧30): 1.4% by weight
- starting temperature of melting (endothermic process): 62° C.

Higher alcohol D
- average carbon atom number: 18
- contents of the ingredients (C≦20): 60% by weight
- contents of the ingredients (C≧30): 0% by weight
- starting temperature of melting (endothermic process): 48° C.

Higher alcohol E
- average carbon atom number: 34
- contents of the ingredients (C≦20): 0.5% by weight
- contents of the ingredients (C≧30): 62% by weight
- starting temperature of melting (endothermic process): 64° C.

Higher alcohol F
- average carbon atom number: 23
- contents of the ingredients (C≦20): 3.5% by weight
- contents of the ingredients (C≧30): 0.4% by weight
- starting temperature of melting (endothermic process): 54° C.

Higher alcohol G
- average carbon atom number: 27
- contents of the ingredients (C≦20): 0.5% by weight
- contents of the ingredients (C≧30): 3.4% by weight
- starting temperature of melting (endothermic process): 60° C.

Preparation of the Higher Fatty Acids

The commercially available linear chain higher fatty acids were purified by a multistage distillation method to prepare the higher fatty acids having different average carbon atom numbers and carbon atom number distributions. The prepared higher fatty acids were mixed and kneaded with a kneader, and then pulverized by means of an air-jet type pulverizer. The pulverized higher fatty acids were classified by means of a zigzag type classifier to obtain the particles of the following higher fatty acids A–G whose average particle size is 6 μm.

Higher fatty acid A average carbon atom number: 22 contents of the ingredients (C≦20): 1.8% by weight contents of the ingredients (C≧30): 0.5% by weight starting temperature of melting (endothermic process): 58° C.

Higher fatty acid B average carbon atom number: 25 contents of the ingredients (C≦20): 0.7% by weight contents of the ingredients (C≧30): 0.3% by weight starting temperature of melting (endothermic process): 61° C.

Higher fatty acid C average carbon atom number: 28 contents of the ingredients (C≦20): 0.4% by weight contents of the ingredients (C≧30): 1.8% by weight starting temperature of melting (endothermic process): 63° C.

Higher fatty acid D average carbon atom number: 18 contents of the ingredients (C≦20): 58% by weight contents of the ingredients (C≧30): 0% by weight starting temperature of melting (endothermic process): 50° C.

Higher fatty acid E average carbon atom number: 34 contents of the ingredients (C≦20): 0.3% by weight contents of the ingredients (C≧30): 60% by weight starting temperature of melting (endothermic process): 65° C.

Higher fatty acid F average carbon atom number: 23 contents of the ingredients (C≦20); 3.4% by weight contents of the ingredients (C≧30): 0.5% by weight starting temperature of melting (endothermic process): 55° C.

Higher fatty acid G average carbon atom number: 27 contents of the ingredients (C≦20): 0.8% by weight contents of the ingredients (C≧30): 3.6% by weight starting temperature of melting (endothermic process): 61° C.

Measuring Method of the Average Carbon Atom Number

A composition of carbon atom numbers of a sample was determined by GPC, and the average carbon atom number was calculated from a histogram of frequency distribution of the composition.

Measuring Method of the Contents of the Aliphatic Higher Alcohols or Higher Fatty Acids having Carbon Atom Numbers of not More than 20 or not less than 30

A composition of carbon atom numbers of a sample was determined by GPC, and the contents of the ingredients having carbon atom numbers of not more than 20 or not less than 30 was calculated from a histogram of frequency distribution of the composition.

Measuring Method of the Starting Temperature of Melting (endothermic process)

A starting temperature of endothermic process was measured by means of a differential scanning calorimeter (DSC-200 manufactured by Seiko Denshi Co.), and said temperature was regarded as the starting temperature of melting. DSC measurement was carried out under the following conditions.

Reference: alumina

Sample: 10 mg

Rate of temperature increase: 10° C./min

Heating range: 20–120° C.

Preparation of Toner Matrix Particles

1. Preparation of a magenta master batch

A mixture of bisphenolic polyester resin (Tg: 58° C., Tm: 100° C.) (70 parts by weight) and magenta pigment (C.I. pigment red 184) (30 parts by weight) was charged into a pressure kneader and kneaded. The kneaded product was cooled, and then pulverized by means of a feather mill to obtain the pigment master batch.

2. Preparation of toner matrix particles

The material containing of the aforesaid polyester resin (93 parts by weight) and the aforesaid pigment master batch (10 parts by weight) was mixed by Henschel mixer, and the mixture was kneaded by means of vented twin-kneader. The kneaded product was cooled, coarsely pulverized by the feather mill, finely pulverized by a jet mill, and then classified to obtain the toner matrix particles whose volume average particle size is 8.5 μm.

Measuring Method of Glass Transition Point (Tg) of a Resin

Differential thermal analysis of the resin was carried out by means of the aforesaid differential scanning calorimeter under the following conditions.

Reference: alumina

Sample: 10 mg

Rate of temperature increase: 10° C./min

Heating range: 20–120° C.

A shoulder value of the main endothermic peak was regarded as the glass transition point.

Measuring Method of Softening Point (Tm) of a Resin

A starting point and a finishing point of a flow of the melted sample from a fine pore of a dice was measured by means of a flow tester under the following conditions.

Size of the fine pore: 1 mm (diameter)×1 mm (length)

Sample: 1 $cm^2$

Pressure: 20 $kg/cm^2$

Rate of temperature increase: 6° C./min

A temperature which corresponds to half of the height of from the starting point to the finishing point was regarded as the softening point.

Particle Size of the Toner

Particle size of the toner was measured by means of Coulter multi-analyzer 2.

Preparation of External Additives

Preparation Example of Hydrophobic Titanium Oxide 1

Anatase type titanium oxide particles (average particle size: 50 nm) prepared by sulfuric acid method was thrown into water, and n-butyl trimethoxysilane (hydrophobizing agent) was added to the aqueous mixture under agitation at the rate of 10% by weight in relation to the titanium oxide. The mixture was dried, and then pulverized to obtain the hydrophobic titanium oxide fine particles 1.

Preparations of Toners

Examples 1–6; Comparative Examples 1–10

According to the blending compositions (parts by weight) shown in Table 1, the external additives and each of the aforementioned higher alcohol particles A–G were added to the toner matrix particles (100 parts by weight), and these components were mixed by Henschel mixer. The mixture was sieved by means of a vibrating shifter to obtain the toner particles 1–16.

Examples 7–12; Comparative Examples 11–20

According to the blending compositions (parts by weight) shown in Table 2, the external additives and each of the aforementioned higher fatty acids A–G were added to the toner matrix particles (100 parts by weight), and these components were mixed by Henschel mixer. The mixture was sieved by means of a vibrating shifter to obtain the toner particles 17–32. In Tables 1 and 2, "H2000" represents a hydrophobic silica H2000 (made by Clariant K.K.).

Preparation of Two-component Developer

1. Preparation of a carrier

Methyl ethyl ketone (100 parts by weight) was charged in a flask (500 ml) equipped with agitator, condenser, thermometer, tube for introducing nitrogen and dropping device, and maintained at 80° C. On the other hand, a solution was prepared by dissolving methyl methacrylate (36.7 parts by weight), 2-hydroxy ethyl methacrylate (5.1 parts by weight), 3-methacryloxypropyl tris (trimethylsiloxy)silane (58.2 parts by weight) and 1,1'-azobis(cyclohexane-1-carbonitrile) (1 part by weight) in methyl ethyl ketone (100 parts by weight). The solution was dripped into the flask over 2 hours, and the reaction mixture was aged at 80° C. for 5 hours.

Isophorone diisocyanate/trimethylolpropan adduct (IPDI/TMP:NCO%=6.1%) was added as a crosslinking agent to the obtained resin in such a way that a molar ratio of OH/NCO becomes 1/1, and the mixture was diluted with methyl ethyl ketone to prepare a coating resinous solution (solid content: 3% by weight).

Calcined ferrite powder F-300 (volume average particle size: 50 $\mu$m; Powder Tec Co.) which is a core material was coated with the aforesaid coating resinous solution by means of Spira Coater (Okada Seiko Co.) in such a way that a coating amount of the resin becomes 1.5% by weight, and the coated ferrite powder was dried to obtain the carrier.

The obtained carrier was left in a circulating hot air oven (160° C.) for 1 hour to thermoset the carrier. After cooling, the ferrite powder bulk was pulverized by means of a vibrating shifter equipped with screen meshes having sieve opening of 106 $\mu$m and 75 $\mu$m to obtain the carrier coated with the resin.

2. Preparation of developers

The developers were prepared by mixing the aforesaid carrier with each of the toners under agitation in such a way that a concentration of the toner becomes 6% by weight.

The characteristics of the toners of the present invention were evaluated according to BS (adhesion of the toner components on the photosensitive member), fogging, image concentration and heat resistance, and the evaluation results are shown in Table 1 and Table 2. The evaluation methods are as follows.

TABLE 1

| | | Adding amounts of external additives | | | Higher alcohols | | Results of the evaluation | | |
|---|---|---|---|---|---|---|---|---|---|
| | Toner | H2000 | Titanium Oxide | Strontium titanate | Type | Adding amounts | BS | Fogging | Heat resistance |
| Ex.1 | Toner 1 | 1.0 | | | B | 1.0 | ◎ | ○ | ◎ |
| Ex.2 | Toner 2 | 1.0 | 1.0 | | B | 1.0 | ◎ | ○ | ◎ |
| Ex.3 | Toner 3 | 1.0 | 1.0 | 2.0 | B | 1.0 | ◎ | ○ | ◎ |
| Ex.4 | Toner 4 | 1.0 | 1.0 | | A | 1.0 | ◎ | ○ | ○ |
| Ex.5 | Toner 5 | 1.0 | 1.0 | | B | 1.0 | ◎ | ○ | ◎ |
| Ex.6 | Toner 6 | 1.0 | 1.0 | | C | 1.0 | ◎ | ○ | ◎ |
| Com. ex.1 | Toner 7 | 1.0 | 1.0 | | D | 1.0 | ◎ | ○ | X |
| Com. ex.2 | Toner 8 | 1.0 | 1.0 | | D | 0.2 | X | ◎ | X |
| Com. ex.3 | Toner 9 | 1.0 | 1.0 | | E | 1.0 | X | ○ | ◎ |
| Com. ex.4 | Toner 10 | 1.0 | 1.0 | | E | 5.0 | Δ | X | ◎ |
| Com. ex.5 | Toner 11 | 1.0 | 1.0 | | F | 1.0 | ◎ | ○ | X |
| Com. ex.6 | Toner 12 | 1.0 | 1.0 | | F | 0.5 | ○ | ◎ | X |
| Com. ex.7 | Toner 13 | 1.0 | 1.0 | | F | 0.5 | X | ◎ | ○ |
| Com. ex.8 | Toner 14 | 1.0 | 1.0 | | G | 1.0 | X | ○ | ◎ |

TABLE 1-continued

| | | Adding amounts of external additives | | | Higher alcohols | | Results of the evaluation | | |
|---|---|---|---|---|---|---|---|---|---|
| | Toner | H2000 | Titanium Oxide | Strontium titanate | Type | Adding amounts | BS | Fogging | Heat resistance |
| Com. ex.9 | Toner 15 | 1.0 | 1.0 | | G | 3.0 | Δ | Δ | ◎ |
| Com. ex.10 | Toner 16 | 1.0 | 1.0 | | G | 5.0 | ○ | X | ◎ |

TABLE 2

| | | Adding amounts of external additives | | | Higher alcohols | | Results of the evaluation | | |
|---|---|---|---|---|---|---|---|---|---|
| | Toner | H2000 | Titanium Oxide | Strontium titanate | Type | Image amounts | BS | concentration | Heat resistance |
| Ex.7 | Toner 17 | 1.0 | | | B | 1.0 | ◎ | ○ | ◎ |
| Ex.8 | Toner 18 | 1.0 | 1.0 | | B | 1.0 | ◎ | ○ | ◎ |
| Ex.9 | Toner 19 | 1.0 | 1.0 | 2.0 | B | 1.0 | ◎ | ○ | ◎ |
| Ex.10 | Toner 20 | 1.0 | 1.0 | | A | 1.0 | ◎ | ○ | ○ |
| Ex.11 | Toner 21 | 1.0 | 1.0 | | B | 1.0 | ◎ | ○ | ◎ |
| Ex.12 | Toner 22 | 1.0 | 1.0 | | C | 1.0 | ◎ | ○ | ◎ |
| Com. ex.11 | Toner 23 | 1.0 | 1.0 | | D | 1.0 | ◎ | ○ | X |
| Com. ex.12 | Toner 24 | 1.0 | 1.0 | | D | 0.2 | X | ◎ | X |
| Com. ex.13 | Toner 25 | 1.0 | 1.0 | | E | 1.0 | X | ○ | ◎ |
| Com. ex.14 | Toner 26 | 1.0 | 1.0 | | E | 5.0 | Δ | X | ◎ |
| Com. ex.15 | Toner 27 | 1.0 | 1.0 | | F | 1.0 | ◎ | ○ | X |
| Com. ex.16 | Toner 28 | 1.0 | 1.0 | | F | 0.5 | ○ | ◎ | X |
| Com. ex.17 | Toner 29 | 1.0 | 1.0 | | F | 0.5 | X | ◎ | ○ |
| Com. ex.18 | Toner 30 | 1.0 | 1.0 | | G | 1.0 | X | ○ | ◎ |
| Com. ex.19 | Toner 31 | 1.0 | 1.0 | | G | 3.0 | Δ | Δ | ◎ |
| Com. ex.20 | Toner 32 | 1.0 | 1.0 | | G | 5.0 | ○ | X | ◎ |

Evaluation of BS (an adhesion of the toner components on the photosensitive member)

The developers prepared as described above were respectively subjected to a durability test in which a duplication of an image (B/W: 15%) was carried out on 10,000 sheets of paper under N/N environmental condition by means of a digital color copying machine CF 900 (Minolta Co., Ltd.). An adhesion of the toner components and external additives to the photosensitive member was evaluated at an initial stage and a stage after the endurance copying by a visual observation and an electron microscope. Furthermore, a solid image was evaluated at the initial stage and the stage after the endurance copying by the visual observation.

The rankings of the aforesaid evaluations are as follows:

"◎": The adhesion of the external additives on the photosensitive member was not found by the electron microscope.

"○": Although the adhesion of the external additives on the photosensitive member was found by the electron microscope, said adhesion was not found by the visual observation, and no image noise occurred.

"Δ": Although the adhesion of the external additives and the toner components on the photosensitive member was found by the visual observation, no image noise occurred.

"X": The adhesion of the external additives and the toner components on the photosensitive member was found by the visual observation, and the adhered material were recognized on the image as a noise.

Evaluation of a Fogging

In the aforesaid test for the evaluation of BS, a fogging on a plain part of the image after the copy of 10,000 sheets of paper was evaluated by a visual observation.

The rankings of the evaluation are as follows:

"◎": No fogging occurred.

"○": Although a texture fogging slightly appeared, there was no problem for the practical use.

"Δ": The textural fogging appeared, and there was a slight fault for the practical use.

"X": A heavy fogging which was not fit for the practical use occurred.

Evaluation of an Image Concentration

The aforementioned developers were respectively set in the digital color copying machine CF 900 (Minolta Co., Ltd.) installed under an environmental condition of low-temperature and low-humidity, and a patch image was copied. The copied image was taken out in an undeveloped state, and an amount of the toner adhered to a sheet of paper (the image concentration) was measured.

The rankings of the evaluation are as follows:

"◎": The adhesion amount of the toner was not less than 0.7 mg/cm$^2$.

"○": The adhesion amount of the toner was not less than 0.6 mg/cm$^2$.

"Δ": The adhesion amount of the toner was not less than 0.5 mg/cm$^2$.

"X": The adhesion amount of the toner was less than 0.5 mg/cm$^2$.

Evaluation of a Heat Resistance

Twenty grams of the toner was charged into a glass screw tube, and capped the screw tube. The capped screw tube was left in a thermostatic chamber (55° C.) under N/N environmental condition. After 24 hours, a cohesion state of the toner was observed.

The rankings of the evaluation are as follows:

"◎": No cohesion of the toner occurred.

"○": There was no problem for the practical use.

"X": There was a problem for the practical use because the cohesion of the toner occurred and a decohesion of the cohered toner could not occur unless the screw tube was vigorously shaken.

The toner according to the present invention exhibits an excellent maintenance of heat resistance, and the same time, the toner not only prevent an adhesion of inorganic fine particles which are added to the toner particles to the photosensitive member, but also suppress an occurrence of BS which becomes an image defect in the process of the blade cleaning.

What is claimed is:

1. A toner which comprises (i) toner particles containing of a binder resin and a colorant and (ii) an external additive comprising of an aliphatic higher alcohol which is externally added to said toner particles, said aliphatic higher alcohol being represented by the following formula (1):

$$H\text{-}(CH_2)_n\text{-}OH \text{ (n: an integer)} \quad (1)$$

wherein number-average carbon atom numbers of the aliphatic higher alcohol are 21–29, contents of the ingredients having carbon atom numbers of not more than 20 are not more than 2% by weight, and contents of the ingredients having carbon atom numbers of not less than 30 are not more than 2% by weight.

2. The toner of claim 1, wherein the aliphatic higher alcohol has a mean particle size of 2–10 μm.

3. The toner of claim 1, wherein the aliphatic higher alcohol has a mean particle size of 4–8 μm.

4. The toner of claim 1, wherein an adding amount of the aliphatic higher alcohol is 0.05–3 parts by weight in relation to 100 parts by weight of the toner particles.

5. The toner of claim 1, wherein the aliphatic higher alcohol has a starting temperature of not less than 55° C. on a melting.

6. The toner of claim 1, wherein the aliphatic higher alcohol has a number-average molecular weight (Mn) of 3000– 6000, and a ratio of Mw (weight-average molecular weight)/Mn of said alcohol is 2–6.

7. The toner of claim 1, wherein the toner particles comprises 0.5–5 parts by weight of a wax in relation to 100 parts by weight of the binder resin.

8. The toner of claim 1, 0.05–5 parts by weight of a post-treating agent is externally added to 100 parts by weight of the toner particles.

9. The toner of claim 8, wherein the post-treating agent is at least one kind of the fine particles selected from the group consisting of inorganic oxide fine particles, inorganic stearic acid compound fine particles and titanic acid compound fine particles.

10. The toner of claim 1, wherein the toner particles have a volume mean particle size of 4–10 μm.

11. The toner which comprises (i) toner particles containing of a binder resin and a colorant and (ii) an external additive comprising a higher fatty acid which is externally added to said toner particles, said higher fatty acid being represented by the following formula (2):

$$H\text{-}(CH_2)_m\text{-}COOH \text{ (m: an integer)} \quad (2)$$

wherein number-average carbon atom numbers of the higher fatty acid are 21–29, contents of the ingredients having carbon atom number of not more than 20 are not more than 2% by weight, and contents of the ingredients having carbon atom numbers of not less than 30 are not more than 2% by weight.

12. The toner of claim 11, wherein the higher fatty acid has a mean particle size of 2–10 μm.

13. The toner of claim 11, wherein the higher fatty acid has a mean particle size of 4–8 μm.

14. The toner of claim 11, wherein an adding amount of the higher fatty acid is 0.05–3 parts by weight in relation to 100 parts by weight of the toner particles.

15. The toner of claim 11, wherein the higher fatty acid has a starting temperature of not less than 55° C. on a melting.

16. The toner of claim 11, wherein the higher fatty acid has a number-average molecular weight (Mn) of 3000–6000, and a ratio of Mw (weight-average molecular weight)/Mn of said fatty acid is 2–6.

17. The toner of claim 11, wherein the toner particles comprises 0.5–5 parts by weight of a wax in relation to 100 parts by weight of the binder resin.

18. The toner of claim 11, 0.05–5 parts by weight of a post-treating agent is externally added to 100 parts by weight of the toner particles.

19. The toner of claim 18, wherein the post-treating agent is at least one kind of the fine particles selected from the group consisting of inorganic oxide fine particles, inorganic stearic acid compound fine particles and titanic acid compound fine particles.

20. The toner of claim 11, wherein the toner particles have a volume mean particle size of 4–10 μm.

* * * * *